United States Patent [19]

Kavnatsky et al.

[11] Patent Number: 5,021,172

[45] Date of Patent: Jun. 4, 1991

[54] PAINT COMPATIBLE PRE-LUBRICANT

[75] Inventors: Zara M. Kavnatsky, Farmington Hills; Tsae S. Chen, Detroit, both of Mich.

[73] Assignee: Diversified Chemical Technologies, Inc., Detroit, Mich.

[21] Appl. No.: 444,324

[22] Filed: Dec. 1, 1989

[51] Int. Cl.[5] ..... C10M 141/02

[52] U.S. Cl. ..... 252/32.7 E; 252/33.3; 252/49.3; 252/52 R; 252/56 R

[58] Field of Search ..... 252/52 R, 56 R, 32.7 E, 252/33.3, 49.3

[56] References Cited

U.S. PATENT DOCUMENTS

| | | | |
|---|---|---|---|
| 3,923,671 | 12/1975 | Knepp | 252/56 R |
| 4,132,662 | 1/1979 | Sturwold | 252/56 R |
| 4,191,658 | 3/1980 | Jahnke | 252/56 R |
| 4,746,448 | 5/1988 | Kenmochi | 252/56 R |
| 4,830,768 | 5/1989 | Reich | 252/56 R |
| 4,844,830 | 7/1989 | Budd | 252/56 R |

FOREIGN PATENT DOCUMENTS

| | | | |
|---|---|---|---|
| 0643663 | 6/1962 | Canada | 252/56 R |
| 0040259 | 3/1979 | Japan | 252/56 R |

*Primary Examiner*—Jacqueline V. Howard
*Attorney, Agent, or Firm*—Krass & Young

[57] ABSTRACT

A pre-lubricant composition for use in metal-forming operations is compatible with aqueous-based paint baths and includes an ester of $C_1$–$C_5$ alcohol and a $C_5$–$C_{25}$ acid in an oil base. The ester is typically a methyl ester and is present in weight concentrations of up to 30%. One specific pre-lubricant composition includes methyl oleate as the ester. The composition may further include corrosion inhibitors, antioxidants, lubricity builders and the like.

10 Claims, No Drawings

PAINT COMPATIBLE PRE-LUBRICANT

FIELD OF THE INVENTION

This invention relates generally to lubricating compositions. More specifically, the present invention relates to a pre-lubricant for use in metal forming operations, which pre-lubricant will not contaminate aqueous based paint baths.

BACKGROUND OF THE INVENTION

Pre-lubricants are oil based, metal working fluids generally applied to metal stock in early stages of processing. The pre-lubricant materials form an oily film on the stock which prevents corrosion during storage and handling, and lubricates the metal during subsequent stamping, drawing or other forming operations. Prelubricants are of particular utility in metal working operations involving steel and aluminum stock, but are also used in conjunction with other metals. Ideally, a prelubricant material should be a good corrosion inhibitor and should have good film forming properties so that it can provide a continuous, oily, protective film on the metal stock. Furthermore, pre-lubricants should provide sufficient lubricity to facilitate the metal forming operations. There are presently available a number of prelubricant compositions and they typically comprise an oil base together with corrosion inhibitors, film forming agents and similar ancillary ingredients.

If the formed metal parts are subsequently painted, plated or otherwise finished it is also desirable that the pre-lubricant composition be readily removable so as to prevent interference of the oil base with finishing operations. Because of concerns relating to the cost, toxicity, flammability and the general undesirability of a number of organic solvents, manufacturers are turning increasingly to the use of aqueous based metal finishing processes. Heretofore employed organic based paint formulations are being replaced by aqueous compositions; and organic degreasing baths are being replaced with systems employing aqueous detergents for removing the pre-lubricant.

In a typical finishing process, such as that employed in the manufacture of automobiles, a formed metal part is cleansed of pre-lubricant material in a two-stage process. The first step is a prewash utilizing aqueous detergents, surfactants and the like. This is usually followed by one or more wash steps utilizing similar chemistry. Washing is typically carried out until water drains from the formed metal part in a uniform, break-free sheet, such draining being considered indicative of the lack of oil residue on the part. The washed part is then treated in an aqueous based zinc phosphate containing bath. If oil residue is present on the part, the zinc phosphate coating will be thin, or absent, and later applied paint layers will form craters or other undesirable surface irregularities. Following the zinc phosphate treatment, the formed metal parts are primed, typically in an electrocoat primer bath.

As is well known to those of skill in the metal finishing arts, electrocoat primer paint is typically a water based composition including various proprietary resins, alcohols and the like. The parts are totally immersed in the bath and an electric field is established therethrough to facilitate the deposition of the paint coat on the part. Following the electrocoat step, a finish paint coat, typically comprised of one or more paint layers, is applied.

The pre-lubricant material can cause several problems in such a process. As mentioned hereinabove, oily residue on the surface of the part can result in poor formation of a zinc phosphate coating and can subsequently cause irregularities in the electrocoat layer. Irregularities in these layers are manifested, and often magnified, in the final finish paint coat.

Although it is desirable to remove the entirety of pre-lubricant residues from the part subsequent to final painting, this goal is frequently not achieved. While washing steps can remove residues from a large area, relatively flat portion of the formed article, metal parts frequently include crevices, folds, seams and like configurations which can trap pre-lubricant material preventing it from being removed in the washing steps. While traces of oil on such interior surfaces are not visible to the eye and hence do no significantly interfere with the quality of the final paint finish, their effects are actually far more serious than cosmetic.

Electrocoat baths are of necessity very large so as to accommodate automobile body panels and the like. These baths frequently contain 10,000 gallons or more of electrocoat paint. This paint is quite expensive and filling a single bath represents a very significant cost to a manufacturer. These baths are replenished as needed, but they are seldom drained because of the expense of raw materials and the undesirability of down time. Traces of pre-lubricant composition trapped in crevices and the like may be leached out of formed articles during painting operations and can contaminate the electrocoat baths and/or finish paint baths. The contaminated bath will produce poorly painted parts and the finished items may manifest defects such as craters, fisheyes and various other irregularities in the final paint coat. Obviously, contamination of a large volume paint bath is an extremely costly accident which necessitates repainting of all of the articles produced in the bath as well as scrapping of the expensive bath.

It will be appreciated that there is a great need for a pre-lubricant composition which is readily removed from formed metal parts by aqueous cleaning solutions; even more importantly, there is needed a pre-lubricant composition which is compatible with various paint baths, and hence will not contaminate them if it is inadvertently introduced thereinto. The present invention provides for a pre-lubricant composition which not only protects metal during handling and lubricates it during forming operations, but which is compatible with aqueous paint formulations. By "compatible" in the context of the present invention is meant that contamination by traces of the pre-lubricant composition does not adversely affect the function of the aqueous based paint baths. The pre-lubricant of the present invention, although an oil-based material, disperses and/or solubilizes into the electrocoat or other paint bath thereby preventing spoilage of the bath.

These and other advantages of the present invention will be readily apparent from the discussion, description, examples and claims which follow.

BRIEF DESCRIPTION OF THE INVENTION

There is disclosed herein a pre-lubricant composition for use in metal forming operations. The prelubricant is compatible with aqueous based paint formulations and comprises by weight approximately 10–30 percent of an ester of a $C_1$–$C_5$ alcohol and a $C_5$–$C_{25}$ carboxylic acid together with approximately 1–20 percent of corrosion inhibitor and approximately 50–90 percent of an oil. In particular embodiments, the ester is a methyl ester. The carboxylic acid may, in some embodiments, be an acid having 10–20 carbon atoms. In one particular embodiment the ester is methyl oleate.

The corrosion inhibitor may include an alkali metal petroleum sulfonate such as sodium or calcium petroleum sulfonate. The corrosion inhibitor may also comprise an oxidized hydrocarbon wax. The pre-lubricant composition may further include other ingredients such as 0.05–.2 percent of an anti-oxidant; 0.1–1 percent of zinc dialkyldithiophosphate and/or a plasticizer such as di-2-ethylhexyl adipate.

One particular class of pre-lubricant compositions structured in accord with the principles of the present invention is comprised, by weight, of approximately 0–6 percent of an oxidized hydrocarbon wax; approximately 10–30 percent of methyl oleate; 1–5 percent of sodium petroleum sulfonate; 0–5 percent of calcium petroleum sulfonate; 0.1–1 percent of zinc dialkyldithiophosphate; 0.05–2 percent of an anti-oxidant and the balance napthenic oil.

DETAILED DESCRIPTION OF THE INVENTION

The present invention is directed to an oil-based prelubricant composition which is compatible with aqueous based paint baths such as primer bath, electrocoat primer baths and finish paint. The pre-lubricant composition includes an ester of a $C_1$–$C_5$ alcohol and a $C_5$–$C_{25}$ carboxylic acid. It has been found in accord with the principles of the present invention that inclusion of an ester of this particular class provides for compatibility of the prelubricant composition with the aqueous paint bath. As noted hereinabove, traces of a compatible pre-lubricant will not adversely contaminate a paint bath so as to degrade the bath and/or cause defects in articles painted therein.

The exact mode of operation of the ester in providing paint compatibility is not specifically understood. Esters of this general class are fairly long molecules having a hydrophobic "tail" comprised of the hydrocarbon chain of the fatty acid and a hydrophilic "head" comprised of the ester linkage. It is suspected that the dual affinities of these ester molecules aid in dispersing, emulsifying, sequestering or otherwise promoting the interaction of traces of oil contaminant with the paint so as to negate any adverse affects therefrom.

There are a variety of esters which may be utilized in accord with the principles of the present invention and one of skill in the art could, in light of the teaching herein, select an ester appropriate for a given set of conditions. The ester should be compatible with the oil base of the pre-lubricant and should be sufficiently polar to interact with the oil and water as mentioned hereinabove. The ester should not interfere with metal forming operations and hence should not detract significantly from the lubricity of the composition. Additional factors to be considered in the selection of an ester will obviously be the cost, availability and stability of the ester. It has been found that methyl esters of fatty acids comprise one class of materials having particular utility in the practice of the present invention. Methyl esters are generally available for a variety of organic acids. Ethyl esters have many properties similar to methyl esters and may also be similarly employed.

The esters of the present invention may be fabricated from a wide variety of organic acids. The prime considerations in the selection of an acid will be its effects on the melting point, vapor pressure, polarity, solubility and lubricity of the ester. In general, it has been found that $C_{10}$–$C_{20}$ acids are well suited for use in the preparation of esters having utility in the present invention. Some acids having particular utility are oleic acid, nondecylic acid, stearic acid, margaric acid, palmitic acid, linoleic acid, linolenic acid as well as various other saturated and unsaturated acids.

One particularly preferred ester is methyl oleate. This ester is commercially available in plentiful supply and at a relatively low cost. It functions quite well to promote the compatibility of pre-lubricating compositions with aqueous paint baths and it manifests good lubricating properties in and of itself. One particular grade of methyl oleate having utility in the present invention is sold by the Keil Chemical Division of the Ferro Corporation of Hammond, Indiana. This material is provided as a white to yellow, low viscosity liquid. It is sparingly soluble in water (less than 0.2%). Its boiling point is higher than 215° F. and it has a specific gravity of approximately 0.88 at 25° C.

When methyl oleate is the ester, it is generally preferred that it be present at approximately 10–30 percent by weight. It has been found that when the amount of methyl oleate is decreased below approximately 10 percent, the compatibility of the composition with paint baths is decreased. The use of methyl oleate in amounts greater than thirty percent tends to decrease the corrosion protection afforded by the pre-lubricant. Most preferably, methyl oleate is employed in approximately twenty percent by weight concentration. It has been found that similar compositional ranges apply to other esters and one of skill int he art could easily determine an appropriate amount of ester by balancing compatibility and corrosion protection factors.

In addition to the ester components, the prelubricant compositions of the present invention also include approximately 1–20 percent of corrosion inhibitors. These compositions, as their name implies, operate to prevent rusting or other corrosion of the metal. There are a wide variety of corrosion inhibitors known and available to those of skill in the art and these materials may be used in various combinations in the present invention.

One particular class of corrosion inhibitors having particular utility in the present invention are the organic corrosion inhibitors; and, the alkaline metal salts of petroleum sulfonates are a group of organic corrosion inhibitors useful in the invention. These materials are generally viscous, oily liquids, which are soluble in hydrocarbons and which, in some instances are emulsifiable in water. The sulfonates aid in preventing rusting or other corrosion of the metals and in some degree enhance the lubricity of the composition. Sodium petroleum sulfonate is typical of one such material. It is characterized as a brown, viscous fluid with a slight petroleum odor and a low vapor pressure (less than one millimeter Hg at 70° F. It has a specific gravity slightly greater than water, is soluble in hydrocarbons and emulsifiable in water. Sodium petroleum sulfonate is available from a number of chemical suppliers and one grade suitable for use in the present invention is the product sold under the trade name of "Petrosul H-60 Sod Sulfonate" by the Penreco Corporation of Butler, Penna., which is a division of the Penzoil Product Company.

Another similar corrosion inhibitor is calcium petroleum sulfonate. This composition has corrosion inhibiting properties similar to sodium petroleum sulfonate, but further acts to improve the humidity resistance of coated articles. Calcium petroleum sulfonate is generally described as being "overbased calcium sulfonate in refined petroleum oil." The material is a viscous oil having a low vapor pressure (less than 50 millimeters Hg at 20° C.). It has a specific gravity of slightly less than one at 70° F. and is sparingly soluble in water. Calcium petroleum sulfonate is available from a number of chemical suppliers and one grade having utility in the present invention is sold under the trade name of "Calcium Petronate 25° C." by the Sonneborn Division of the Witco Chemical Co. located in Petrolia, Penna.

There are a variety of other corrosion inhibitors which may be utilized in addition to, or instead of, the foregoing materials. Various oxidized hydrocarbons are one such group of compounds having utility as corrosion inhibitors. Ideas, Inc. of Wood Dale, Ill. sells a corrosion inhibitor under the trade name "Ida-Soil D-906". This material is characterized as an oxidized hydrocarbon wax and is supplied as a dark amber solid and it provides corrosion protection to metal parts in acid atmospheres. A similar product sold by the same company under the trade name "Ida-Soil D-903" has similar properties.

Other types of corrosion inhibitors may be similarly employed. For example, the Alox Corporation of Niagara Falls, New York sells a number of rust inhibitors under the trade name of "Aqualox". These materials are broadly described of amine salts of carboxylic acids in which the oxygenated hydrocarbon portion of the acid can be either aliphatic or aromatic. Various other corrosion inhibitors are known and may be similarly employed.

The pre-lubricant composition of the present invention may further include stabilizers, lubricity builders, viscosity control agents and other such ancillary ingredients as are well known to those of skill in the art. For example, the pre-lubricant may include zinc dialkyldithiophosphate. This material serves to boost the lubricating ability of various oil compositions. Zinc dialkyldithiophosphate is available from a variety of suppliers and one such composition is sold under the registered trademark "Lubrizol 677A" by the Lubrizol Corporation of Wickliffe, Ohio. This material is an oil-based solution of zinc dialkyldithiophosphate which contains approximately 8.3 to 8.7 percent phosphorus, 17.0 to 18.2 percent sulfur and 8.85 to 10 percent zinc.

The pre-lubricant compositions of the present invention may also preferably include antioxidant compounds such as di-t-butyl cresol and the like. Such materials increase the humidity resistance of metals protected by the composition. One such antioxidant is sold by the Lubrizol Corporation under the tradename "Lubrizol 817" and is provided as a white powder, insoluble in water, having a specific gravity of approximately 1.05 at 20° C.

It has been found that the addition of various plasticizers and thickeners serves to build a smoother film of the pre-lubricant material. One particular plasticizer having utility in the present invention is di-2-ethylhexyl adipate. This material is sold under the registered trademark "Plasthall" by the C.P. Hall Company of Chicago, Ill. It has also been found that the addition of relatively small amounts (i.e. 0.5–1.5%) of free fatty acids can enhance the clarity of the prelubricant composition. For example, addition of about .5% of oleic acid seems to facilitate solubilization of the ingredients of the prelubricant.

In general, the base oil for the pre-lubricant of the present invention comprises any one of a number of medium density petroleum hydrocarbons available from a variety of sources. One material with particular utility is a napthenic-based oil sold under the trade name of "100 SUS Napthenic" by the Eppert Oil Company of Detroit, Mich.

The following examples detail the preparation of particular pre-lubricant compositions of the present invention.

EXAMPLE 1

One particular pre-lubricant composition was prepared by melting 56 grams of oxidized hydrocarbon wax ("Idasoil D906") and 24 grams of sodium petroleum sulfonate (Petrosul H-60 Sod Sulfonate"), at approximately 150° F. until a homogeneous solution was obtained. To this mixture was added 200 grams of methyl oleate (Keil Chemical), 20 grams of calcium petroleum sulfonate, ("Calcium Petronate 25c") 5 grams of zinc dialkyldithiophosphate ("Lubrizol 677A") and 1 gram of di-2-butyl cresol ("Lubrizol 817"). The mixture was stirred to provide a homogeneous solution and 682 grams of napthenic oil ("100 SUS Viscosity Napthenic") was then added. Then 12 grams of oleic acid was added and stirring was continued until a homogeneous solution was obtained.

The thus prepared pre-lubricant material was applied to a number of steel test panels. These pieces were exposed to relative humidities of 100% at temperatures of 100° F. for periods of time up to 3 days and no evidence of rusting was noted. The thus treated metal panels were subsequently washed in a phosphate based detergent at 70° C., rinsed, rewashed, rerinsed and treated in a zinc phosphate bath and painted in an electrocoat primer bath. The primed pieces, which exhibited a uniformly coated surface, were subsequently painted with an aqueous based high solids automotive paint. The finish coat was smooth, uniform and exhibited no cratering, fisheyes or other such defects.

The compatibility of the pre-lubricant with electrocoat baths was assessed by adding approximately 5 milliliters of the foregoing composition to 1 liter of electrocoat primer. The mixture was stirred for 12 hours and cleaned, non pre-lubricated steel samples were electrocoated with the primer. The primed steel exhibited a smooth surface, free of defects. Applications of a finish coat to the primed samples yielded a defect free surface.

EXAMPLE 2

A composition similar to the foregoing was prepared except that the methyl oleate was eliminated and the amount of napthenic oil increased to 882 grams. The composition was applied to steel plates as in the foregoing example. The lubricated metal plates exhibited no corrosion after being stored at 100° F. and 100% relative humidity for up to 3 days. The coated samples were washed, as in the foregoing example, and treated in a zinc phosphate bath and painted in an electrocoat primer bath. The primed sheets manifested some cratering defects. Application of the high solids finish paint thereto provided a surface finish characterized by a number of crater-type defects approximating 6–10 per 24 square inches.

The compatibility of the pre-lubricant with primer and electrocoat baths was assessed by adding approximately 5 milliliters of the composition to 1 liter of electrocoat primer. The mixture was stirred for 12 hours and cleaned, non pre-lubricated steel samples were electrocoated with the primer. The primer coat on the steel samples was somewhat uneven and included a number of crater defects. Application of a finish paint coat to the primed samples yielded a finish having approximately 5-10 craters per 24 square inches. In general, it has been found that there is very wide range of compositions which may be prepared in accord with the principles of the present invention. In general, incorporation, by weight, of approximately 10-30% of the ester into a pre-lubricant composition will strike an acceptable balance between paint bath compatibility and rust protection. A general composition will typically include 10-30% of the ester, 1-20% of corrosion inhibitor and 50-90% of a lubricant oil.

A more specific composition in accord with the principles of the present invention comprises by weight between 0 and 6% of an oxized hydrocarbon wax; 10-30% of the ester; approximately 1-6% of sodium petroleum sulfonate: approximatelY 0-6% of calcium sulfonate: approximatelY 0.1-1% of zinc dialkyldithiophosphate; approximately 1.3% of oleic acid; and approximately 0.05-.2% of an antioxidant.

It will be appreciated that in keeping with these general guidelines, a great variety of pre-lubricant compositions may be fabricated in accord with the principles of the present invention. Accordingly, the foregoing discussion, description and examples are merely illustrative of particular embodiments of the present invention and are not limitations upon the practice thereof. It is the following claims, including all equivalents, which define the scope of the invention.

We claim:

1. A pre-lubricant composition for use in metal forming operations, which is compatible with aqueous based paint formulations, said pre-lubricant comprising by weight:

0-6% of an oxidized hydrocarbon wax;
10-30% of metyl oleate;
1-5% of sodium petroleum sulfonate;
0-5% of calciumpetroleum sulfonate;
0.1-1% of zinc dialkyldithioiphosphate;
0.05-2% of an antioxidant;
0.5-1.5% of oleic acid; and
the balance napthenic oil.

2. A pre-lubricant as in claim 1, wherein said methyl oleate is present in a concentration no greater than 20%.

3. A pre-lubricant as in claim 1, wherein said oxidized hydrocarbon wax comprises approximately 5-6% of said composition.

4. A pre-lubricant as in claim 1, wherein said sodium petroleum sulfonate comprises approximately 2-3% of said composition.

5. A pre-lubricant as in claim 1, wherein said calcium petroleum sulfonate comprises approximately 1-2% of said composition.

6. A pre-lubricant as in claim, wherein said zinc dialkyldithiophosphate comprises approximately 0.5-.7% of said composition.

7. A pre-lubricant as in claim 1, wherein said antioxidant comprises di-t-butyl cresol.

8. A pre-lubricant as in claim 11 further including a di-2-ethylhexyl adipate containing plasticizer.

9. A pre-lubricant composition for use in metal forming operations, which is compatible with aqueous based paint formulations, said pre-lubricant comprising by weight:

5.6% of an oxidized hydrocarbon wax;
20% of methyl oleate;
2.4%.sodium petroleum sulfonate;
1-2% calcium petroleum sulfonate;
0.5-.7% zinc dialkyldithiophosphate;
1% di-t-butyl cresol; and
the balance, a napthenic oil.

10. pre-lubricant as in claim 9, further including 0.5-1.5% of oleic acid.

* * * * *

UNITED STATES PATENT AND TRADEMARK OFFICE

CERTIFICATE OF CORRECTION

PATENT NO. : 5,021,172

DATED : June 4, 1991

INVENTOR(S) : Zara M. Kavnatsky, Tsae S. Chen

It is certified that error appears in the above-identified patent and that said Letters Patent is hereby corrected as shown below:

Column 8, Line 4, Please delete "metyl" and insert -- methyl --.

Column 8, Line 22, Please delete "as in claim" and insert -- as in claim 1 --.

Column 8, Line 38, Please delete "1%" and insert -- .1% --.

Signed and Sealed this

Thirteenth Day of October, 1992

*Attest:*

DOUGLAS B. COMER

*Attesting Officer*

*Acting Commissioner of Patents and Trademarks*